US006969813B1

(12) United States Patent
Winslett et al.

(10) Patent No.: US 6,969,813 B1
(45) **Date of Patent: *Nov. 29, 2005**

(54) DIRECT MOUNT ROTARY HANDLE OPERATING MECHANISM WHICH IS SUITABLE FOR ISOLATION

(75) Inventors: Michael Troy Winslett, Fairburn, GA (US); W. Dale Robbins, Snellville, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/925,048

(22) Filed: Aug. 24, 2004

(51) Int. Cl.[7] ..... H01H 9/28
(52) U.S. Cl. ..... 200/330; 200/51.11
(58) Field of Search ..... 200/329–331, 200/50.01, 11, 50.17–25; 361/605–610, 615

(56) References Cited

U.S. PATENT DOCUMENTS 3,301,972 A * 1/1967 Brumfield ..... 200/17 R
4,612,424 A * 9/1986 Clark et al. ..... 200/50.18
5,219,070 A 6/1993 Grunert et al. ..... 200/330
5,288,958 A * 2/1994 Grunert et al. ..... 200/331
5,493,084 A * 2/1996 Whitaker et al. ..... 200/50.05
6,423,912 B1 * 7/2002 Arenz et al. ..... 200/43.08
6,596,952 B1 7/2003 Degrazia et al. ..... 200/330
6,797,903 B1 * 9/2004 Winslett et al. ..... 200/331

OTHER PUBLICATIONS

U.S. Appl. No. 10/776,142, filed Feb. 2, 2004.

* cited by examiner

*Primary Examiner*—Elvin G. Enad
*Assistant Examiner*—M. Fishman
(74) *Attorney, Agent, or Firm*—José R. de la Rosa

(57) ABSTRACT

A direct mount rotary handle operating mechanism for operating a circuit breaker having electrical contacts. The handle mechanism includes a driver coupled to the circuit breaker and a handle having a socket for receiving the driver. The socket is configured to allow the handle to rotate relative to the driver. The handle further includes a movable locking pin. A lock latch is associated with the driver, wherein the lock latch includes a flange portion. When the electrical contacts of the circuit breaker are welded closed and a torque is applied to the handle, the handle rotates to a position in which the pin is blocked from being inserted into the locking hole by the flange portion thereby preventing the handle from being locked in an OFF position when the contacts are welded together.

16 Claims, 3 Drawing Sheets

DIRECT MOUNT ROTARY HANDLE OPERATING MECHANISM WHICH IS SUITABLE FOR ISOLATION

FIELD OF THE INVENTION

The present invention relates to a direct mount rotary handle operating mechanism used with circuit breakers, and more particularly, to a lock latch having a flange portion wherein when the electrical contacts of a circuit breaker are welded closed the flange portion prevents a handle of the handle mechanism from being locked in an OFF position.

BACKGROUND OF THE INVENTION

Circuit breakers, both single and multi-phase circuit breakers, typically include a lever or other device for manually operating the circuit breaker. Frequently, it is desirable that the lever be operated through the use of a mechanical interface, such as a direct mount rotary handle operating mechanism having a handle that may be manually operated, wherein the handle mechanism is of the type that is directly mounted to the circuit breaker.

In operation, the handle mechanism moves the circuit breaker lever to its various operative positions. This includes an "ON" position, an "OFF" position and a "RESET" position. In some instances, it is necessary to lock the handle mechanism in the OFF position so as to safeguard personnel working on associated equipment. However, when the electrical contacts of the circuit breaker have become welded closed, usually as a result of a short circuit condition, locking the handle mechanism in an OFF position would create a dangerous and inappropriate condition since a user would believe that the circuit breaker is in the OFF (electrical contacts open) condition, when in fact the electrical contacts are welded closed.

Conventional handle mechanisms include a locking portion that will not enable locking of the handle when the contacts are welded together. This is commonly referred to as "Suitable for Isolation" or "Positive OFF". In addition, the handle will return to indicate the ON position when the handle is released. These are safety features that indicate to the user that the contacts are welded and that substantially reduce the likelihood that others working on the equipment would mistakenly believe that the contacts are open.

However, conventional handle mechanisms rely on the proper positioning of the handle as a way of ensuring that it will not lock during Positive OFF. The disadvantage of such mechanisms is, that with wear, the position of the handle mechanism approaches the locked position. Further, such mechanisms rely on the force limits set by standard specifications, such as those set by the International Electrotechnical Commission (IEC), in order to ensure the handle cannot be locked.

Thus there is a need for a direct mount rotary handle operating mechanism for a circuit breaker that will prevent the handle from being locked in an OFF position when the electrical contacts of the circuit breaker are in fact closed, such as in a welded closed condition.

SUMMARY OF THE INVENTION

A direct mount rotary handle operating mechanism for operating a circuit breaker having electrical contacts is disclosed. The handle mechanism includes a driver coupled to the circuit breaker and a handle having a socket for receiving the driver. The handle mechanism further includes a lock latch which is associated with the driver. The lock latch includes a flange portion. When the electrical contacts of the circuit breaker are welded closed and a torque is applied to the handle, the flange portion prevents the handle from being locked in an OFF position by blocking a locking hole.

These and other features of the present invention can be best understood from the following specification and drawings, the following of which is a brief description.

DETAILED DESCRIPTION OF THE INVENTION

Figure 1:
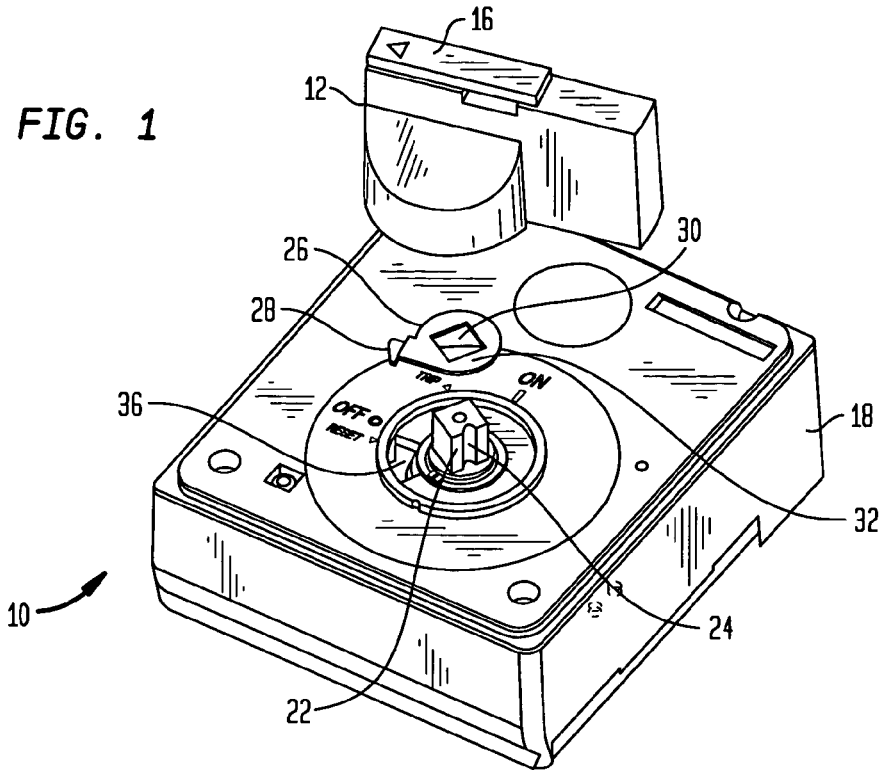
FIG. 1 is an exploded view of a direct mount rotary handle operating mechanism in accordance with the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of FIGS. 1–7.

Figure 2:
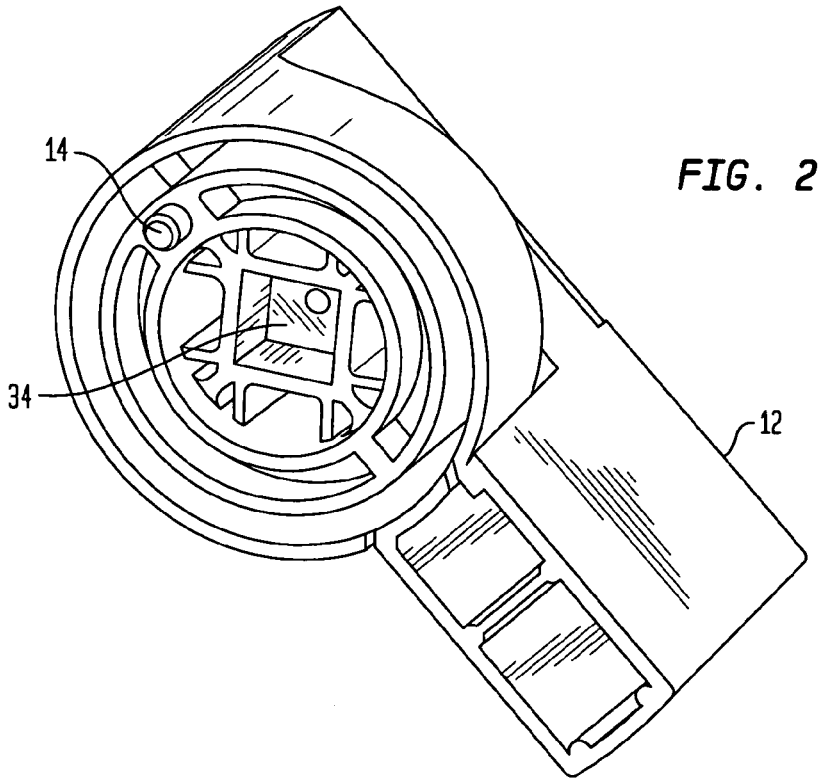
FIG. 2 is a rear view of a handle for the direct mount rotary handle operating mechanism of the present invention.

Referring to FIG. 1, a direct mount rotary handle operating mechanism 10 in accordance with the present invention is shown. The handle mechanism 10 includes a handle 12. Referring to FIG. 2, a rear view of the handle 12 is shown. The handle 12 includes a locking pin 14. The pin 14 is moveable between an extended position wherein the pin 14 extends out from the handle 12 and a retracted position wherein the pin 14 is located within the handle 12. The handle 12 includes a hasp 16 which is connected to a pin mechanism such as that manufactured by Siemens Energy & Automation, the assignee herein or by Siemens AG, the parent company of the assignee herein, wherein the pin mechanism is located within the handle 12. The pin mechanism serves to move the pin 14 between the extended and retracted positions when the hasp 16 is correspondingly extended outward and retracted inward, respectively, by a user. In FIG. 2, the pin 14 is shown in the outward position.

Figure 3:
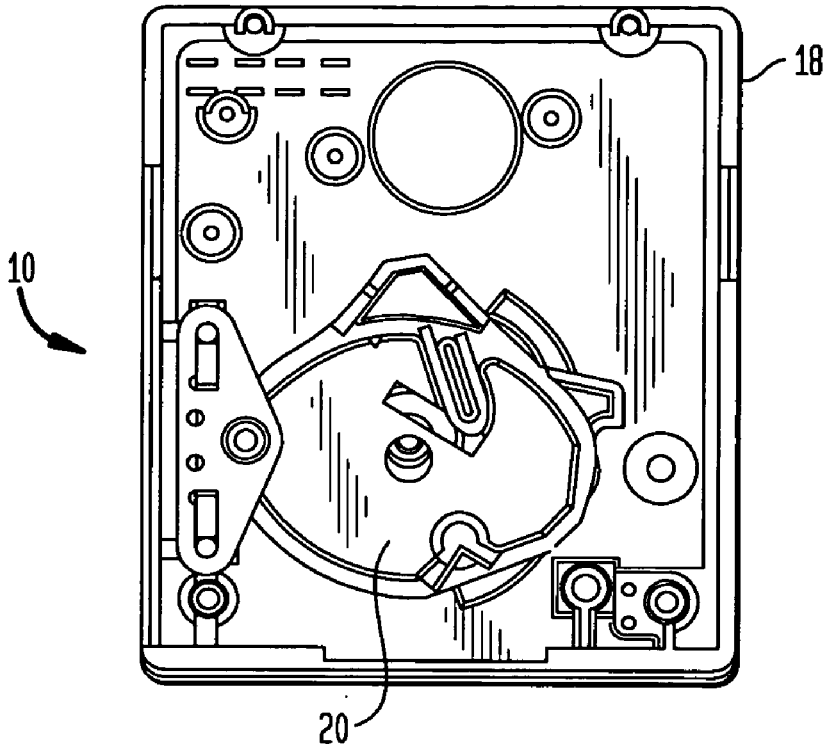
FIG. 3 is a rear view of the direct mount rotary handle operating mechanism.
Figure 4:
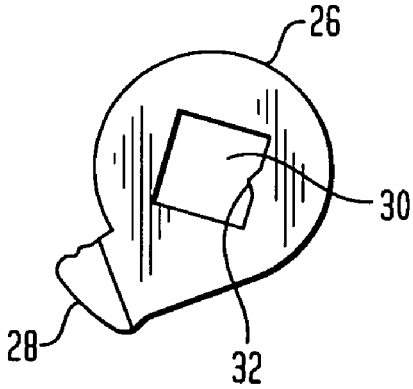
FIG. 4 is a view of a lock latch in accordance with the present invention.

The handle mechanism 10 includes an enclosure 18 having indicia to indicate the OFF, ON, RESET and TRIP positions of an associated circuit breaker. Referring to FIG. 3, a rear view of the handle mechanism 10 is shown. The handle mechanism 10 further includes a cam mechanism 20, such as that manufactured by Siemens Energy & Automation, the assignee herein, or by Siemens AG, the parent company of the assignee herein. The cam mechanism 20 is adapted to be connected to a circuit breaker lever such that rotation of the handle 12 to the OFF, ON, RESET and TRIP positions causes the circuit breaker lever to be moved to corresponding positions. Referring back to FIG. 1, a driver element 22 is operatively connected to the cam mechanism 20 and extends from the enclosure 18. The driver 22 is substantially square shaped and includes a slot 24.

In accordance with the present invention, the handle mechanism 10 includes a substantially circularly shaped lock latch 26 (also shown in FIG. 4) having an extended flange portion 28 and a central aperture 30 for receiving the driver 22. The lock latch 26 is sized such that it fits snugly about the driver 22. The lock latch 26 also includes a key 32 for insertion into the slot 24 so as to locate the flange portion 28 relative to the driver 22. The lock latch 26 may be fabricated from metal and formed by stamping or other suitable fabrication. Alternatively, the lock latch 26 and flange portion 28 may be formed as a one piece assembly and incorporated into either the handle 12, driver 22 or enclosure 18. In another embodiment, a molding or extrusion process may be used to fabricate the lock latch 26 together with either the handle 12, driver 22 or enclosure 18 to form a one piece assembly. Further, the lock latch 26 may be formed as an interrelated two piece assembly wherein one piece is associated with the handle and a second piece is associated with driver, for example.

Referring back to FIG. 2, the handle 12 also includes a molded socket 34 for receiving the driver 22. The socket 34 is sized and molded such that the handle 12 is able to rotate about the driver 22 within the range of approximately 2 to 8 degrees, such as approximately 6 degrees, toward the RESET/OFF direction. The handle 12 and socket 34 may be fabricated from any suitable material such as plastic and may be molded or extruded. Alternatively, a spring mechanism may be used to bias the handle into an appropriate position.

Figure 5:
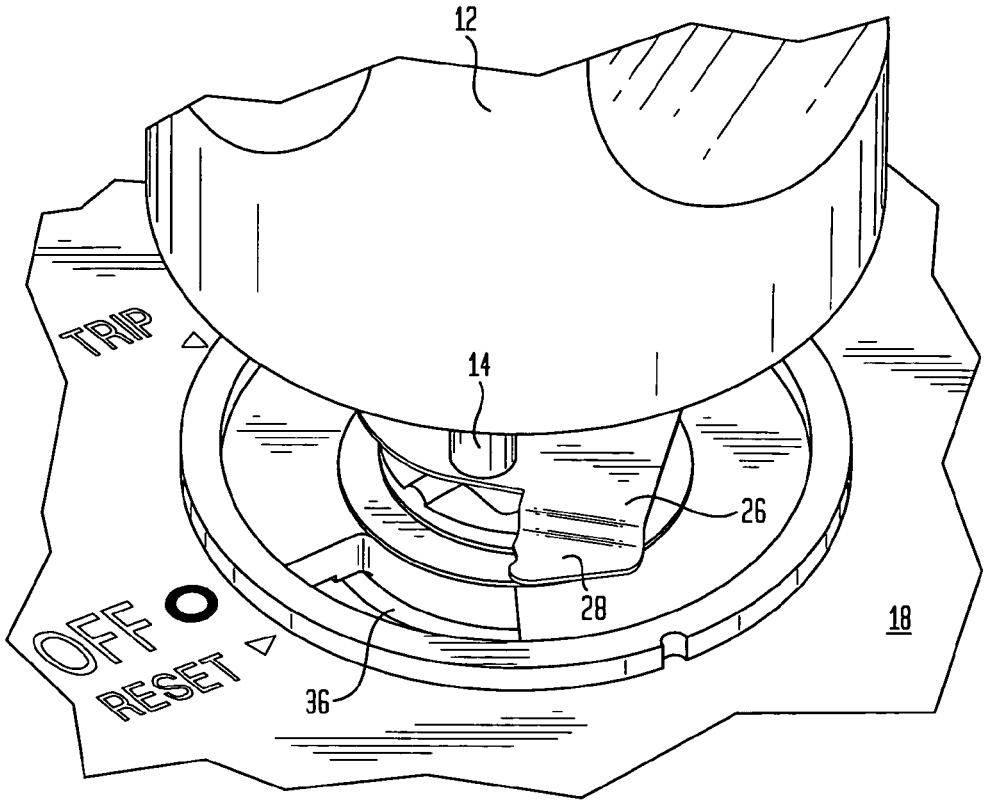
FIG. 5 is an enlarged view of portions of a pin, enclosure and the handle of the direct mount rotary handle operating mechanism.

Referring to FIG. 5 in conjunction with FIG. 2, an enlarged view of portions of the handle 12, pin 14 and enclosure 18 is shown. The enclosure 18 further includes a locking slot or hole 36 positioned for receiving the pin 14. During normal operation, such as when the contacts are not welded together, the handle 12 is not subjected to an opposing torque by the driver 22 when the handle 12 is rotated to the OFF position. In the OFF position, the hasp 16 may then be pulled up by a user to extend the pin 14 into the locking hole 36 to thus lock the handle 12.

The flange portion 28 of the lock latch 26 is shown positioned adjacent an end of the locking hole 36. The flange portion 28 serves to block the locking hole 36 to thus prevent the handle 12 from being locked when the circuit breaker contacts are welded. It is noted that the lock latch 26 may be formed in any suitable shape consistent with the function of blocking the locking hole 36. In particular, when the handle 12 is turned toward the OFF position when the contacts are welded, a torque is exerted on the handle 12 by the driver 22 which urges the handle 12 back to the ON position.

Figure 6:
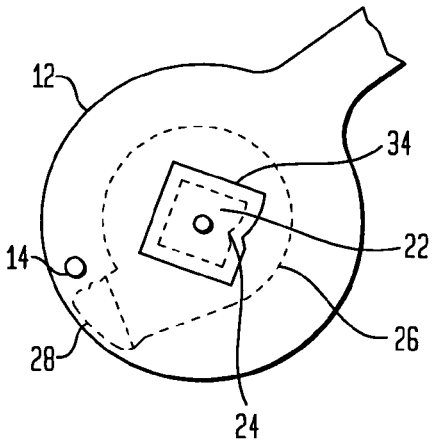
FIG. 6 shows portions of the handle, lock latch and the enclosure prior to positioning of the pin over a flange portion of the lock latch.
Figure 7:
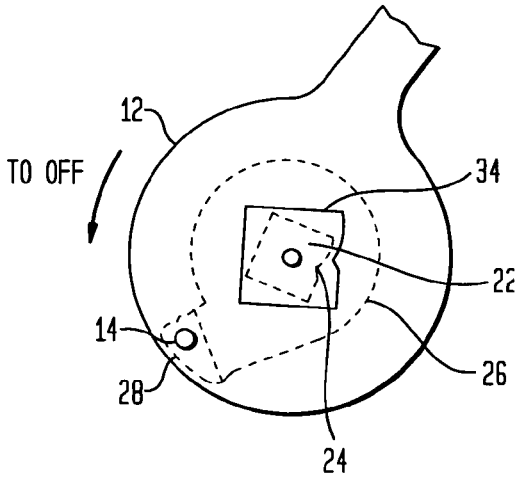
FIG. 7 shows portions of the handle, lock latch and the enclosure after the pin is positioned over the flange portion.

Reference now is made to FIGS. 6–7, which show portions of the handle 12, lock latch 26 and the enclosure 18. Due to the configuration of the handle socket 34 as previously described, the handle 12 is able to rotate freely for approximately 6 degrees until the socket 34 contacts edges of the driver 22. This positions the pin 14 over the flange portion 28 of the lock latch 26, thus blocking the locking hole 36 and preventing the handle 12 from being locked. Further, the lock latch 26 and thus the flange portion 28 rotate in unison with the pin 14 as the handle 12 is rotated, thus blocking the locking hole 36.

As such, the lock latch 26 prevents the handle mechanism 10 from being locked if torque is applied to the handle 12, such as occurs when the contacts are welded together. Therefore, the method by which locking is prevented is independent of handle 12 location when the contacts are welded together. Furthermore, the pin 14 may only be inserted into the locking hole 26 only if no torque is applied to the handle 12, such as when the contacts are not welded together.

A method for preventing a handle 12 of a handle mechanism 10 from being locked in an OFF position when contacts of a circuit breaker are welded closed will now be described, wherein the handle mechanism 10 includes a driver 22 which is coupled to the circuit breaker. The method includes providing the handle 12 with a socket 34 for receiving the driver 22. The method also includes providing a lock latch 26 having a flange portion 28 which is configured to block a locking hole 36. In addition, the method includes covering the locking hole 36 with the flange portion 28 when torque is applied to the handle 12.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A direct mount rotary handle operating mechanism for operating a circuit breaker having electrical contacts, comprising:

a driver coupled to said circuit breaker;

a handle having a socket for receiving said driver; and a lock latch associated with said driver, wherein said lock latch includes a flange portion and wherein when said electrical contacts are welded closed and a torque is applied to said handle, said flange portion prevents said handle from being locked in an OFF position by blocking a locking hole.

2. The handle mechanism according to claim 1, wherein said socket is configured to allow said handle to rotate approximately 6 degrees relative to said driver.

3. The handle mechanism according to claim 1, wherein said handle includes a pin adapted to be inserted into said locking hole.

4. The handle mechanism according to claim 3, wherein said handle rotates in unison with said flange portion to thus block insertion of said pin into said locking hole when torque is applied to said handle.

5. The handle mechanism according to claim 1, wherein said lock latch is fabricated from metal.

6. The handle mechanism according to claim 1, wherein said handle may be locked in said OFF position when no torque is applied to said handle by said driver.

7. A method for preventing a handle of a direct mount rotary handle operating mechanism from being locked in an OFF position when contacts of a circuit breaker are welded closed, said handle mechanism having a driver coupled to said circuit breaker, comprising the steps of:

providing a handle having a socket for receiving said driver;

providing a lock latch having a flange portion configured to block a locking hole; and covering said locking hole with said flange portion when torque is applied to said handle.

8. The method according to claim 7, wherein said socket is configured to allow said handle to rotate approximately 6 degrees relative to said driver.

9. The method according to claim 7, wherein said handle includes a pin adapted to be inserted into said locking hole.

10. The method according to claim 9, wherein said handle rotates in unison with said flange portion to thus block insertion of said pin into said locking hole when torque is applied to said handle.

11. The method according to claim 7, wherein said handle may be locked in said OFF position when no torque is applied to said handle by said driver.

12. A direct mount rotary handle operating mechanism for operating a circuit breaker having electrical contacts, comprising:

a driver coupled to said circuit breaker;

a handle having a socket for receiving said driver and configured to allow said handle to rotate approximately 6 degrees relative to said driver, said handle further including a movable locking pin; and a lock latch associated with said driver, wherein said lock latch includes a flange portion and wherein when said electrical contacts are welded closed and a torque is applied to said handle, said handle rotates to a position wherein said pin is blocked from being inserted into said locking hole by said flange portion thereby preventing said handle from being locked in an OFF position.

13. The handle mechanism according to claim 12, wherein said handle rotates in unison with said flange portion to thus block insertion of said pin in said locking hole when torque is applied to said handle.

14. The handle mechanism according to claim 12, wherein said lock latch is fabricated from metal.

15. The handle mechanism according to claim 12, wherein said handle may be locked in said OFF position when no torque is applied to said handle by said driver.

16. The handle mechanism according to claim 12, wherein said handle is fabricated from plastic.

* * * * *